US005131164A

United States Patent [19]

Miller

[11] Patent Number: 5,131,164

[45] Date of Patent: Jul. 21, 1992

[54] INDEXING APPARATUS FOR ALIGNING CUTOUTS

[76] Inventor: Robert E. Miller, 1559 Maple La., Apt. D, Elgin, Ill. 60123

[21] Appl. No.: 688,827

[22] Filed: Apr. 22, 1991

[51] Int. Cl.[5] ..... G01B 5/14

[52] U.S. Cl. ..... 33/613; 33/451; 33/427

[58] Field of Search ..... 33/613, 418, 419, 427, 33/428, 464, 194, 528, 571, 501, 451, 197, 484, DIG. 10

[56] References Cited

U.S. PATENT DOCUMENTS

| | | | |
|---|---|---|---|
| D. 230,628 | 3/1974 | Sunley . | |
| 579,952 | 4/1897 | Campbell | 33/427 |
| 735,207 | 8/1903 | Campbell | 33/419 |
| 1,199,591 | 9/1916 | Melara | 33/427 |
| 1,220,664 | 3/1917 | Maxwell | 33/427 |
| 1,630,414 | 5/1927 | Baier . | |
| 2,830,378 | 4/1958 | Givan . | |
| 3,522,658 | 8/1970 | Howell . | |
| 3,672,064 | 6/1972 | Elkins et al. | 33/528 |
| 3,678,588 | 7/1972 | Isola et al. . | |
| 3,842,510 | 10/1974 | Elliott . | |
| 3,950,857 | 4/1976 | Zanavich . | |
| 4,059,907 | 11/1977 | Dauber | 33/528 |
| 4,126,941 | 11/1978 | Clarke . | |
| 4,241,510 | 12/1980 | Radecki | 33/613 |
| 4,285,135 | 8/1981 | Minozzi, Jr. | 33/528 |
| 4,423,555 | 1/1984 | Wootten | 33/613 |
| 4,503,615 | 3/1985 | Schreiber | 33/1 M |
| 4,599,805 | 7/1986 | Padilla | 33/484 |
| 4,696,113 | 9/1987 | Rice | 33/197 |
| 4,813,149 | 3/1989 | Herkimer | 33/451 |
| 4,989,332 | 2/1991 | Worrallo | 33/451 |

FOREIGN PATENT DOCUMENTS

| | | | |
|---|---|---|---|
| 83198 | 3/1921 | Fed. Rep. of Germany | 33/427 |

*Primary Examiner*—William A. Cuchlinski, Jr.
*Assistant Examiner*—C. W. Fulton

[57] ABSTRACT

An indexing apparatus aligns cutouts to be formed in a panel with objects which are located on a structure. The indexing apparatus includes a holder having first and second guides. The first and second guides each have a front and rear face and include an elongate slot which slidably engages a spacer having a length. The slot on the first guide holds the length of the spacer normal to the length of the spacer in the slot on the second guide. A tapered portion located on the first and second guides adjacent the slot frictionally engage the spacer as the spacer slides through the slot to hold the spacer in a plurality of selected positions relative to the holder.

20 Claims, 1 Drawing Sheet

INDEXING APPARATUS FOR ALIGNING CUTOUTS

BACKGROUND OF THE INVENTION

1. Field of the Invention

This invention relates to indexing apparatus and, particularly, to indexing apparatus for aligning cutouts to be formed in a panel.

2. Background Art

Recent improvements in mass production of home builders' supplies have provided an immense variety of superior merchandise for use in home improvement and have added impetus to the growth of carpentry as a leisure time endeavor for the hobbyist. Furthermore, the increased activity in these contemporary "do-it-yourself" ventures can be attributed to man's natural urge to provide improvements to his surroundings. For a small investment in time and money, one can completely cover existing wall structure with an inexpensive, durable and attractive paneling or the like.

Oftentimes, an aperture or hole must be cut in a sheet of paneling to accommodate objects and fixtures, such as electrical outlets, a gas pipe, or the like. Proper alignment of the cutouts or holes is often difficult, and a miscalculation in placement of the cutout can spoil the appearance and render a panel unsuitable for its originally designed location. Such an error causes unneeded waste in material and time, and accordingly, an apparatus which is designed to properly index the exact location to cut an aperture or hole in a sheet of paneling in order to enable the fixture to be received therein is desirable. It is also desirable that such an indexing apparatus be simple in design and operation, rugged in construction, inexpensive to purchase, and accurate in application.

The various indexing apparatus currently available have various drawbacks. For instance, U.S. Pat. No. 1,630,414 to Baier shows an indexing apparatus including a screw for engaging a scale to hold the scale in the proper position. U.S. Pat. No. 2,830,378 to Givan shows an indexing apparatus including a clamping nut 25 which must be rotated to clamp scales 6 and 7. An additional indexing apparatus, in U.S. Pat. No. 3,672,064 to Elkins, also shows thumbscrews which provide a means for releasably holding measuring arms/rods in an extended or retracted position relative to the housing. The prior art devices have a significant number of parts which increases manufacturing costs and assembly time.

As can be appreciated, the fixture, electrical outlet, or the like can often be placed in an inconvenient position. Consequently, it may often be difficult to have a free hand to tighten or loosen a screw or other adjustable means while holding both scales in place.

None of the above-identified references shows an indexing apparatus having scaled graduations marked thereon. When transferring the dimensions of the object, for example an electrical outlet, to the paneling or the like, the scales are often in an inconvenient position to read the graduations to calibrate the dimensions of the object because the scales are adjusted for indexing purposes. The provision of a nonadjustable scale on the indexing apparatus would obviate this problem.

None of the above-identified references includes a level meter on the indexing apparatus for indicating the orientation of the indexing apparatus. A level meter provides a means for checking the accuracy of the indexing means. For example, assuming the right angle formed by two sides of an electrical box are level, when transferring the dimensions to the paneling it would be desirable to have a level meter on the indexing apparatus to verify the orientation of the indexing apparatus. By using a level meter, the accuracy of the cutout in the paneling is assured.

SUMMARY OF THE INVENTION

An object, therefore, of the invention is to provide an improved indexing structure having a nonadjustable frictional holder for a spacing element/rod that slides through a slot to hold the spacing element/rod in a selected position.

In the exemplary embodiment of the present invention, generally, an indexing apparatus includes first and second elongate spacing/measuring rods. A holder defines first and second guide slots for the first and second elongate spacing/measuring rods. First cooperating structure is provided on the holder and the first spacing/measuring rod guides movement of the first rod lengthwise of the first rod in the first guide slot relative to the holder along a first line. Second cooperating structure is provided on the holder and the second spacing/measuring rod guides movement of the second rod lengthwise of the second rod in the second guide slot relative to the holder along a second line that is transverse to the first line. The first and second cooperating structures each include fixed, facing wall surfaces on the holder for frictionally engaging one of the rods with a grasping force that allows the rod to be translated relative to the holder by applying a substantial force on the rods in the direction of the translatory movement thereof. The grasping force is sufficient to maintain a preselected relative position between the rods and the holder to allow the transfer of measurements taken from the structure to a panel to be cut to fit the structure.

In a further feature of the invention, the first and second guide slots have a substantially rectangular cross-section, preferably to accept a conventional yardstick.

In still a further feature of the present invention, the holder includes scaled graduations marked along the first and second guide slots to allow small objects, such as electrical boxes, to be readily measured.

In still a further embodiment, the first and second elongate spacing/measuring rods have scaled graduations marked thereon to facilitate the taking of measurements.

In another embodiment of the present invention, the holder includes a first level for determining the orientation of the first guide slot with respect to horizontal. A second level is mounted normal to the first level and determines the orientation of the second guide slot with respect to horizontal. The holder preferably has straight edges which align with the length of the guide slots to allow the holder to be used as an ordinary level and a T-square.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages thereof, may be best understood by reference to the following description taken in conjunction with the accompanying drawings, in which like reference numerals identify like elements in the Figures and in which:

DETAILED DESCRIPTION OF THE PREFERRED EMBODIMENT

Figure 1:
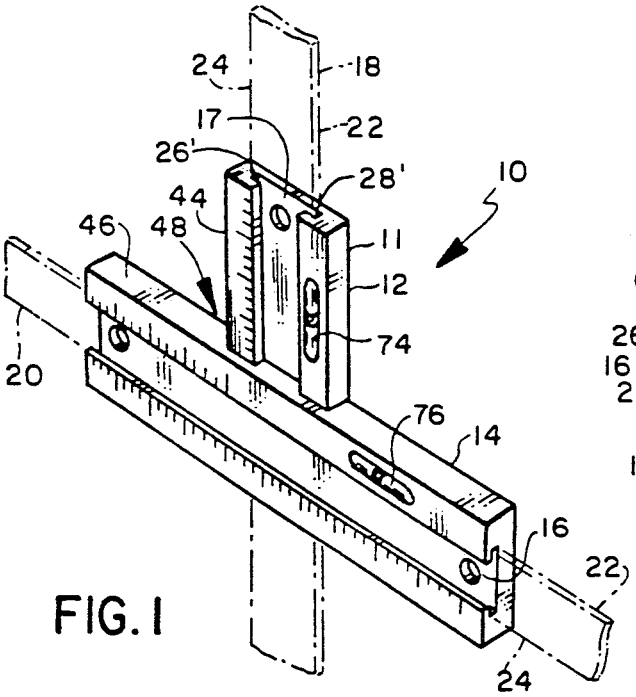
FIG. 1 is a perspective view of the indexing apparatus of the present invention.

The concepts of this invention are exemplified in an indexing apparatus 10, illustrated in FIGS. 1-5. The indexing apparatus 10 includes first and second guides 12, 14, respectively, which define a T-shaped holder 11. Each of the first and second guides 12, 14, respectively, defines an elongate slot 16, 17 for slidably receiving first and second spacing/measuring rods 18, 20, for example and preferably conventional yardsticks having a rectangular cross-sectional dimension of 5/32"×1-5/32". Each of the first and second spacing/measuring rods 18, 20, respectively, has a length of approximately 48". The first and second guides 12, 14, respectively, hold the length of the first rod 18 normal to the length of the second rod 20.

The first and second rods 18, 20 are frictionally maintained in a preselected relative position with respect to the indexing apparatus 10. Each of the first and second rods 18, 20 includes opposite edges 22, 24. The spacing-/measuring rods 18, 20 are held in the preselected position by the friction generated between facing wall surfaces 26, 28, bounding the first and second guides 12, 14 and the opposite edges 22, 24 on the rods 18, 20. The slot 17 is bounded by like surfaces 26', 28' which frictionally grasp the rods 18, 20. The rods 18, 20 can be adjusted simply by moving them within the first and second guides 12, 14, respectively, by applying a sufficient force to overcome the frictional force acting between the guides 12, 14 and the rods 18, 20. There is no need for an adjusting thumbscrew, or the like, which is conventionally used to hold the position of measuring rods.

The indexing apparatus 10 is ideally suited for aligning cutouts 34 to be formed in a panel 36 with an object 38, for example an electrical box, which is to be located within the cutout 34 when the panel 36 is affixed to a wall frame 40. An edge 44 of the first guide 12 and an edge 46 of the second guide 14 define a right-angle template 48 for locating the object 38. The right-angle template 48 of the indexing apparatus 10 is first aligned with the object 38. The first and second rods 18, 20, respectively, are both aligned with a fixed structure in close proximity to the object 38. For example, the first rod 18 is abutted to a floor surface 52 at arrow 53, while the second rod 20 is aligned with an edge 54 of an adjacent panel 56 at arrow 57. The indexing apparatus 10 is then ready to transfer the cutout 34 to the panel 36.

Since the rods 18, 20 are positively held in place due to the friction between the facing wall surfaces 26, 28 on the first and second guides 12, 14, respectively, and the opposite edges 22, 24 on the first and second rods 18, 20, the indexing apparatus 10 can transfer the cutout 34 to the correct position on the panel 36. Since the panel 36 will rest on the floor 52, the first rod 18 can be aligned with a bottom edge 58 of the panel 36 at arrow 59. Similarly, since panel 36 will abut the adjacent panel 56, the second rod 20 can be aligned with a lateral edge 60 of the panel 36 at arrow 61.

The indexing apparatus 10 includes uniform graduations 64 marked on a front face 66 of the first and second guides 12, 14, respectively. Both the right-angle template 48 and the graduations 64 are used to transfer the dimensions and shape of the cutout 34 to the panel 36. After the template 48 is used to locate a lower right corner 70 of the object 38, the first and second rods 18, 20, respectively, can be removed from the indexing apparatus 10 so that the indexing apparatus 10 can be used as a T-square.

Both the first and second guides 12, 14, respectively, include a bubble level 74, 76, respectively. The bubble levels 74, 76 in conjunction with the graduations 64 can be used to facilitate taking and transferring of measurements. For example, if there is no reference point to align one of the rods 18, 20 to, the levels 74, 76 may be used to assist measurement transfer. Further, the levels 74, 76 permit the holder 11 to be used as an ordinary level, as to mark vertical and horizontal lines on a subjacent surface.

Figure 3:
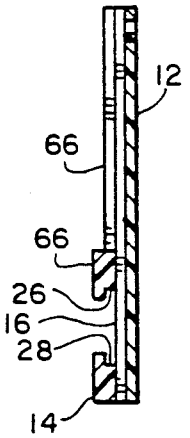
FIG. 3 is a cross-sectional side view of the indexing apparatus of the present invention.
Figure 2:
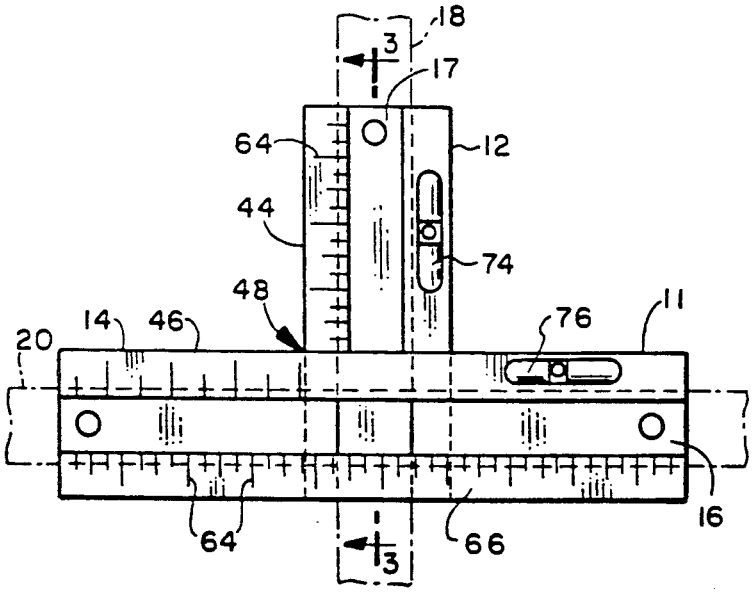
FIG. 2 is a front view of the indexing apparatus of the present invention.
Figure 4:
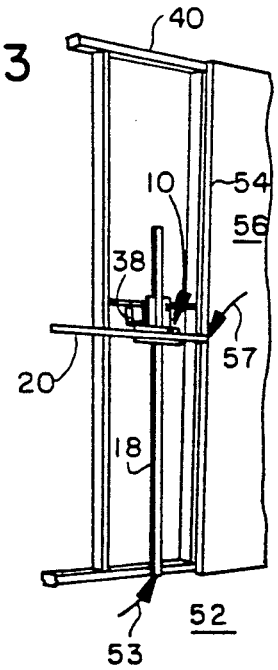
FIG. 4 is a perspective view of the indexing apparatus aligning an electrical outlet.
Figure 5:
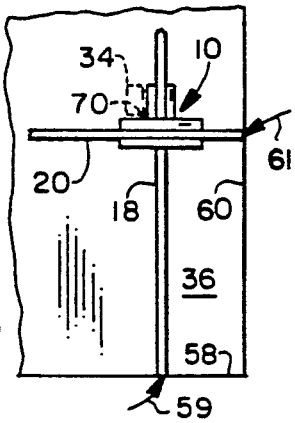
FIG. 5 is a top view of the indexing apparatus transferring the alignment of the electrical box to a panel.

Holder 11 can be formed of various materials. For example as shown in FIG. 3, the holder 11 can be formed from several layers of machined Plexiglas TM or in one piece through injection molding. The clear holder 11 allows the user to view through the holder 11 which, at times, may facilitate the taking and transferring of measurements. Another alternative might be injection molding both the first and second guides 12, 14, respectively, and then fastening them together.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An indexing apparatus for aligning cutouts to be formed in a panel with objects which are located on a structure and which are to be received within the cutouts with the panel affixed to the structure, the indexing apparatus comprising:

first and second elongate spacing/measuring rods;

a holder having a front face and defining first and second guide slots, each with spaced ends, for the first and second elongate spacing/measuring rods;

first cooperating means on the holder and the first spacing/measuring rod for guiding movement of the first rod lengthwise in the first guide slot relative to the holder along a first line, said first slot being a through slot that allows the spacing/measuring rod to be slidable from one end of the first slot into and fully through the first slot to out of the other end of the first slot;

second cooperating means on the holder and the second spacing/measuring rod for guiding movement of the second rod lengthwise in the second guide slot relative to the holder along a second line that is transverse to the first line, said second slot being a through slot that allows the spacing/measuring rod to be slidable from the end of the second slot into and fully through the second slot to out of the other end of the second slot, said first and second cooperating means each including fixed, facing wall surfaces on the holder for frictionally engaging one of the rods with a grasping force that allows the rod to be translated relative to the holder by applying a substantial force on the rod in the direction of translatory movement thereof, said grasping force being sufficient to maintain a preselected relative position between the rod and holder to allow the transfer of measurements taken from a structure to a panel to be cut to fit the structure; and means for giving a visual indication of the relationship of at least one of the first and second lines to level in one of a vertical and horizontal direction.

2. The indexing apparatus of claim 1 wherein said first and second guide slots each have a substantially rectangular cross-section.

3. The indexing apparatus of claim 1 wherein said holder includes scaled graduations marked along said first and second guide slots.

4. The indexing apparatus of claim 1 wherein at least one of said first and second elongate spacing/measuring rods has scaled graduations marked thereon.

5. The indexing apparatus of claim 1 wherein said holder is T-shaped.

6. The indexing apparatus of claim 1 wherein the means for giving a visual indication of the at least one line to level includes a first level means for determining the orientation of the first line with respect to horizontal and a second level means for determining the orientation of the second line with respect to vertical.

7. The indexing apparatus of claim 6 wherein the first and second level means are each an elongate bubble level and the second level means is mounted normal to the first level means.

8. The indexing apparatus of claim 6 wherein the first and second level means are readable from the front face of the holder.

9. The indexing apparatus of claim 6 wherein said first and second level means are bubble levels.

10. The indexing apparatus of claim 1 wherein said holder is made from transparent material.

11. The indexing apparatus of claim 4 wherein at least one of said first and second guide slots is exposed at said front face of said holder.

12. The indexing apparatus of claim 1, wherein each of said first and second guides has a substantially rectangular outer cross-section which together define a right angle template for transferring a right angle to said object.

13. The indexing apparatus of claim 1 wherein at least one outer edge of said first guide and at least one outer edge of said second guide intersect at a right angle to form a right-angle template.

14. The indexing apparatus of claim 1 wherein at least one of said first and second spacing/measuring rods has a rectangular cross-section of approximately 5/32"×1-5/32".

15. The indexing apparatus of claim 14 wherein said at least one of said first and second spacing/measuring rods has a length of 48".

16. The indexing apparatus of claim 1 wherein at least one of said facing wall surfaces and said elongate spacing/measuring rods being deformable to allow said facing wall surfaces to squeeze the elongate spacing-/measuring rods to effect said grasping force and hold said elongate spacing/measuring rods in said preselected relative position.

17. The indexing apparatus of claim 1 wherein the facing wall surfaces are non-adjustable, each relative to the other.

18. The indexing apparatus of claim 1 wherein at least one of said first and second elongate spacing/measuring rods is a conventional yardstick.

19. The indexing apparatus of claim 1 wherein said holder has a flat T-shaped rear surface for facial engagement with a flat surface from which a measurement is to be taken.

20. The indexing apparatus of claim 1 wherein said holder has an opening to expose one of the first and second guide slots over the entire extent of the one of the first and second guide slots along one of said first and second lines.

* * * * *